US007021886B2

(12) United States Patent
Fuller et al.

(10) Patent No.: US 7,021,886 B2
(45) Date of Patent: Apr. 4, 2006

(54) PAPER SUPPLY SYSTEM AND CART FOR A HIGH-SPEED SHEET FEEDER

(75) Inventors: Charles C Fuller, Shelton, CT (US); John R Masotta, Milford, CT (US); William J Wright, Killingworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 488 days.

(21) Appl. No.: 10/121,638

(22) Filed: Apr. 12, 2002

(65) Prior Publication Data

US 2003/0193129 A1 Oct. 16, 2003

(51) Int. Cl.
*B65G 59/08* (2006.01)

(52) U.S. Cl. ..... 414/795.8; 271/157; 414/416.09; 414/389; 414/573

(58) Field of Classification Search ..... 271/157; 414/789.7, 795.8, 389, 390, 401, 402, 416.09, 414/416.11, 573, 574
See application file for complete search history.

(56) References Cited

U.S. PATENT DOCUMENTS 3,070,204 A 12/1962 Bradshaw
3,881,718 A 5/1975 Fernandez-Rana et al.
3,915,338 A 10/1975 Kronseder et al.
4,452,440 A 6/1984 Fagan et al.
4,504,053 A * 3/1985 Shiozawa ..... 271/34
4,566,685 A 1/1986 Irvine et al.
5,404,817 A 4/1995 Cuff
5,562,385 A * 10/1996 Tacchi et al. ..... 414/391
5,871,209 A 2/1999 Orchard et al.
5,971,691 A * 10/1999 Munson et al. ..... 414/398
6,095,513 A * 8/2000 Wright et al. ..... 271/94
6,174,122 B1 * 1/2001 Krooss et al. ..... 414/412
6,736,584 B1 * 5/2004 Dehn et al. ..... 414/396

FOREIGN PATENT DOCUMENTS

WO WO02/26603 4/2002

* cited by examiner

*Primary Examiner*—Janice L. Krizek
(74) *Attorney, Agent, or Firm*—Michael J. Cummings; Charles R. Malandra, Jr.; Angelo N. Chaclas

(57) ABSTRACT

A method and system are disclosed for delivering and feeding a stack of paper to a high-speed sheet feeder. A sheet handling cart is removably connectable to a docking station attached to the high-speed sheet feeder. The sheet handling cart comprises a paper trough which is liftable from the rest of the cart. The paper trough has a trough bottom which longitudinally forms an elongated opening narrower than the bottom of the paper trough, the elongated opening being dimensioned to accommodate a conveyor belt that will protrude upward through the rectangular opening, after the paper trough is lifted from the rest of the cart, in order to advance the stack of paper toward the high-speed sheet feeder.

9 Claims, 8 Drawing Sheets

PAPER SUPPLY SYSTEM AND CART FOR A HIGH-SPEED SHEET FEEDER

TECHNICAL FIELD

The present invention relates to paper supply devices and systems, and more particularly to paper supply systems and carts for high-speed sheet feeders.

BACKGROUND OF THE INVENTION

High-speed sheet feeders are well known in the art. See, for example, Wright et al. (U.S. Pat. No. 6,095,513) which discloses a bottom sheet feeder for feeding sheets from the bottom of a vertical sheet stack wherein each sheet of paper is substantially horizontal in the stack. To operate any high-speed sheet feeder effectively, sheet stacks must be delivered and supplied to the sheet feeder in an efficient manner.

To operate efficiently, a high-speed sheet feeder requires a large stack of paper to operate at optimum speed, but a problem with a large vertical stack is that it necessitates a sheet feeder that is unacceptably high above floor-level if sheets are fed from the top of the paper stack. In the case of a bottom sheet feeder, an unacceptable weight would be placed on each sheet fed from the bottom of a large vertical paper stack. When the weight of the vertical stack of paper is too great, the bottom sheet becomes frictionally engaged with an overlying sheet and therefore two or more sheets are frequently fed from the stack (in the industry this problem is called "doubling"). Doubling causes jams and necessitates shutdowns to clear the jams, and doubling furthermore reduces the smooth flow of paper and limits the rate at which sheets are fed into the high-speed sheet feeder. In addition to the problem of doubling, the bottom sheet feeder may not feed at all, which is known as the "stalling" problem. Pressurized air can somewhat relieve these bottom feeder problems, as seen in Strobel Jr. (U.S. Pat. No. 3,934,869), but still the vertical stack of paper cannot be large.

It is known in the art to use a document loading cart that carries a horizontal stack of paper to a sheet feeder, instead of a vertical stack. For example, the GBR 470 marketed by GBR Systems Corporation is a document loading module of that type. Unfortunately, document loading carts of that type have a number of drawbacks. For example, those carts must remain in place while the stack of paper is being fed to the sheet feeder, which prevents the cart from being used to quickly obtain another stack of paper. Conceivably, a second cart of the same type could be used to obtain another stack of paper, but such a solution would entail much unnecessary duplication of equipment (e.g., both carts would require a frame, wheels, stack advancing means, et cetera). Furthermore, existing carts of that type (e.g., like the GBR 470) are inefficient in that many parts, such as stack advancement means, could instead be permanently located at the sheet feeder instead of being unnecessarily carted around. A further problem with those old sheet feeding carts is that they are designed to interface only with bottom sheet feeders instead of sheet feeders specifically designed to accommodate a horizontal stack of paper, and this lack of compatibility entails unnecessary sheet feeding steps.

SUMMARY OF THE INVENTION

The present invention is a sheet handling system and cart for delivering a stack of paper to a high-speed sheet feeder, the sheet handling cart being removably connectable to a docking station attached to the high-speed sheet feeder.

The present system for delivering a stack of paper to a high-speed sheet feeder comprises the sheet handling cart including a frame and a paper trough that is liftable from the frame, the paper trough having a trough bottom that forms an elongated opening. The system also comprises a docking station connected at least indirectly to the high-speed sheet feeder, wherein the docking station has a station docking mechanism for removably attaching the sheet handling cart to the docking station. The system further comprises an elevating conveyor belt connected at least indirectly to the docking station, for protruding upward through the elongated opening of the trough bottom in order to advance the stack of paper toward the high-speed sheet feeder. The system also includes at least one detector for obtaining information regarding a position of the stack of paper. The at least one detector is operatively connected to the elevating conveyor belt so that the elevating conveyor belt will operate in response to the position of the stack of paper.

The sheet handling cart of the present invention comprises a frame, and also a paper trough for carrying the stack of paper, the paper trough being liftable from the frame. The sheet handling cart further comprises means for moving the cart to the docking station, and at least one cart docking mechanism for removably attaching the cart to the docking station. The paper trough has at least one trough contact surface for lifting the paper trough from the frame. The paper trough furthermore has a trough bottom which longitudinally forms an elongated opening narrower than the bottom of the paper trough, the opening being dimensioned to accommodate a conveyor belt that will protrude upward through the rectangular opening after the paper trough is lifted from the frame, in order to advance the stack of paper toward the sheet feeder.

The present sheet handling cart delivers and supplies a sheet stack to a high-speed sheet feeder effectively and efficiently. The present invention allows a high-speed sheet feeder to operate at optimum speed by supplying the sheet feeder with a large stack of paper, the stack being roughly horizontal, instead of problematically vertical. Therefore, the sheet feeder need not be high above floor-level, nor will there be an unacceptable weight placed on each sheet fed from the stack.

Unlike other carts that carry a horizontal stack of paper to a sheet feeder, the present cart need not remain in place while the stack of paper is being fed to the sheet feeder. Instead, the paper trough is removable from the cart, so the cart can be used to get another stack. This approach allows efficient delivery of paper stacks, while eliminating the need for a second cart. Furthermore, the present cart does not include stack advancement means or a motor therefor; those parts are instead permanently located at the sheet feeder instead of being carted around unnecessarily. A further advantage of the present cart is that it may interface with a high-speed sheet feeder that is not necessarily a bottom feeder. In other words, the present cart will preferably supply sheets of paper to a high-speed sheet feeder that is designed to accept sheets of paper that are approximately vertical instead of horizontal.

BEST MODE FOR CARRYING OUT THE INVENTION

Figure 1:
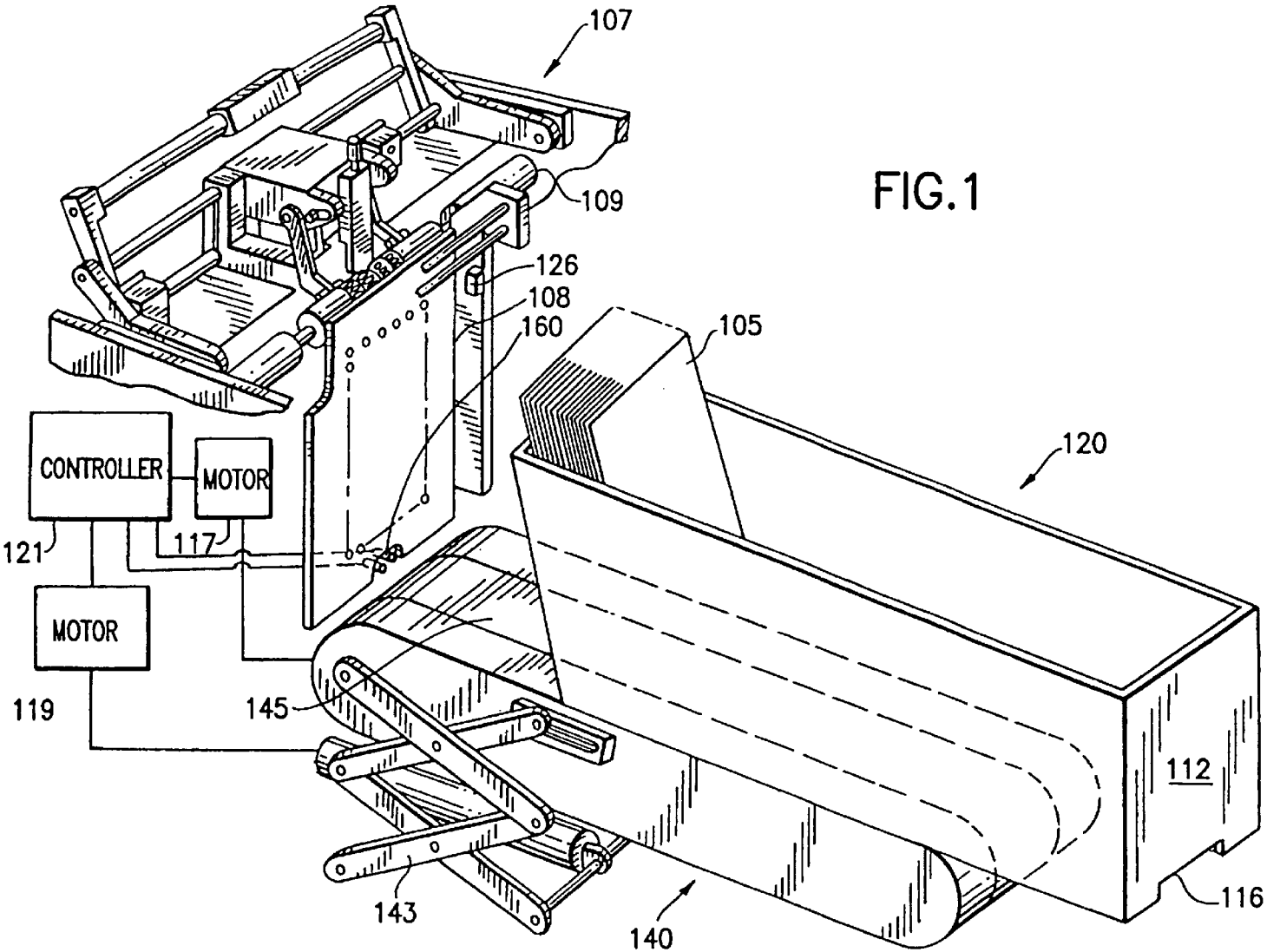
FIG. 1 is a side view of the high-speed sheet feeder and the paper trough after the paper trough has been lifted off the sheet handling cart.

As can be seen in FIG. 1, a paper trough 120 is lifted by an elevating conveyor 140 that includes a conveyor belt 145. The stack of paper 105 will be advanced by the conveyor belt 145 toward the high-speed sheet feeder 107. In this embodiment, the high-speed sheet feeder 107 includes (or is attached to) at least one detector 160 that allows the conveyor belt 145 to be controlled based upon the distance from the detector to the bottom of the stack of paper 105.

The high-speed sheet feeder 107 also includes a vertical feed drum 109, a vertical feed deck 108, and an elevating mechanism 143. In practice, the paper trough 120 will be close enough to the feed deck 108 so that the stack of paper 105 will be sufficiently near the feed drum 109 to feed sheets of paper seriatim to the feed drum 109, and thence into the rest of the high-speed sheet feeder 107.

Figure 2:
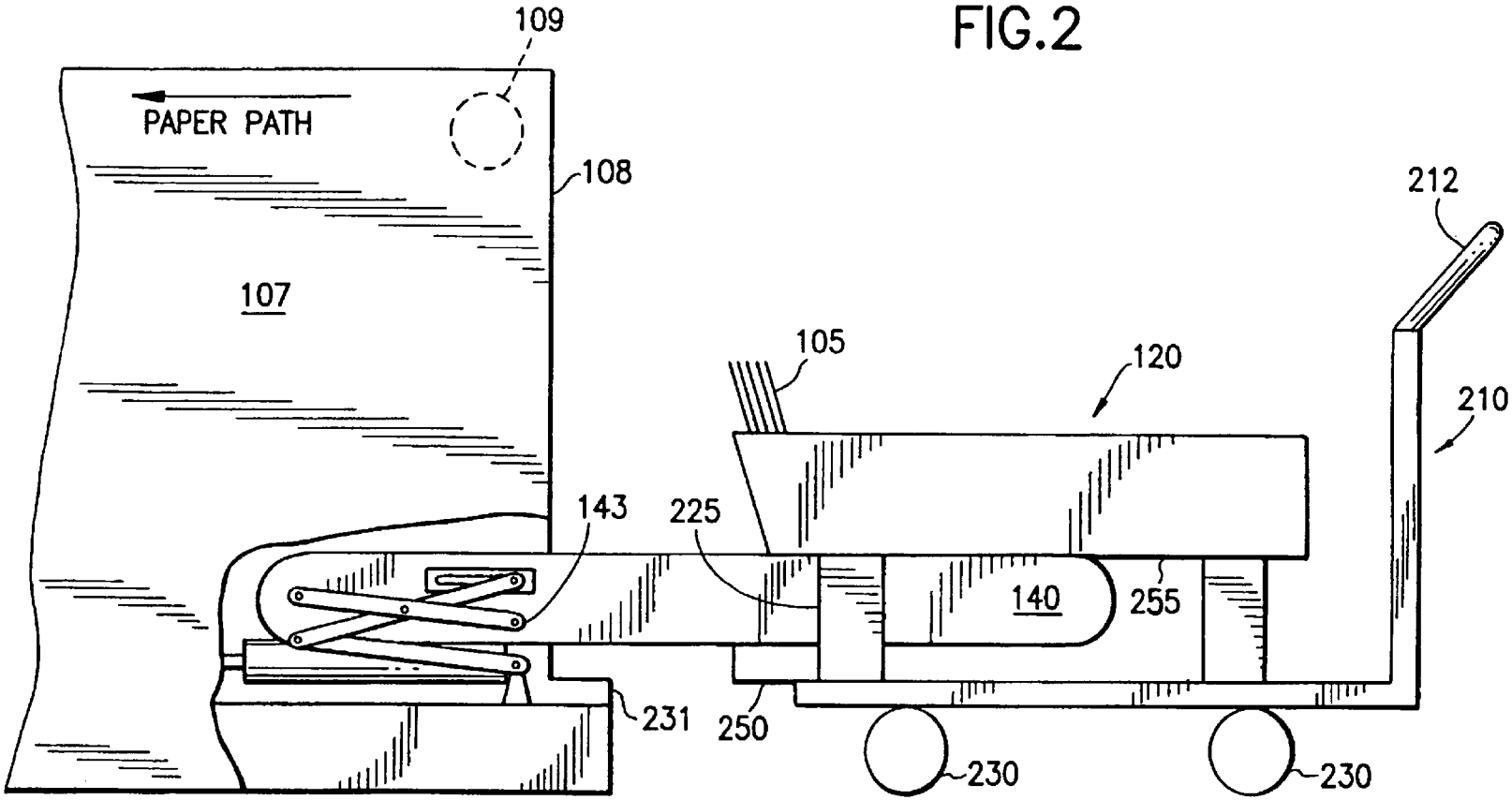
FIG. 2 is a side view of the sheet handling cart in the process of docking at the high-speed sheet feeder.

The sheet handling and paper supply system of the present invention may advantageously be used in conjunction with the high-speed sheet feeder of Wright et al. (U.S. Pat. No. 6,095,513), particularly if Wright is modified so that its feed deck is vertical instead of horizontal. FIG. 2 shows a sheet handling cart 210 carrying the trough 120 to the high-speed sheet feeder 107, as the sheet handling cart is about to dock with the sheet feeder 107. The cart 210 is for delivering the stack of paper 105 to the high-speed sheet feeder 107. The cart 210 is removably connectable to a docking station and mechanism 231 that is attached to the high-speed sheet feeder 107, and therefore the cart 210 includes a cart docking mechanism 250 for removably attaching the sheet handling cart to the docking station 231. The cart 210 includes the paper trough 120 for carrying the stack of paper 105. The cart 210 furthermore includes wheels 230 or the like for moving the sheet handling cart to the docking station, but other devices such as ball bearings could also be used for this purpose. When the trough 120 has been lifted from the cart's frame 271, there is no need for the sheet handling cart to remain in place and, for example, can be removed from the docking station 231 and rolled away to get another trough containing another stack of paper The paper trough 120 is liftable from the cart frame 271. The paper trough 120 has at least one trough contact surface 255 for lifting the paper trough 120 from the frame 271. As the cart docks with the docking station 231, the elevating conveyor 140 slides under the contact surface 255, and this is possible because the sheet handling cart 210 includes (in this embodiment) a cart support piece 225 that creates a space between the trough contact surface 255 and the rest of the cart 210. The support piece 225 thus ensures that, when the sheet handling cart connects to the docking station, the trough contact surface 255 is at least partly exposed. The conveyor 140 is supported by the elevating mechanism 143.

Figure 3:
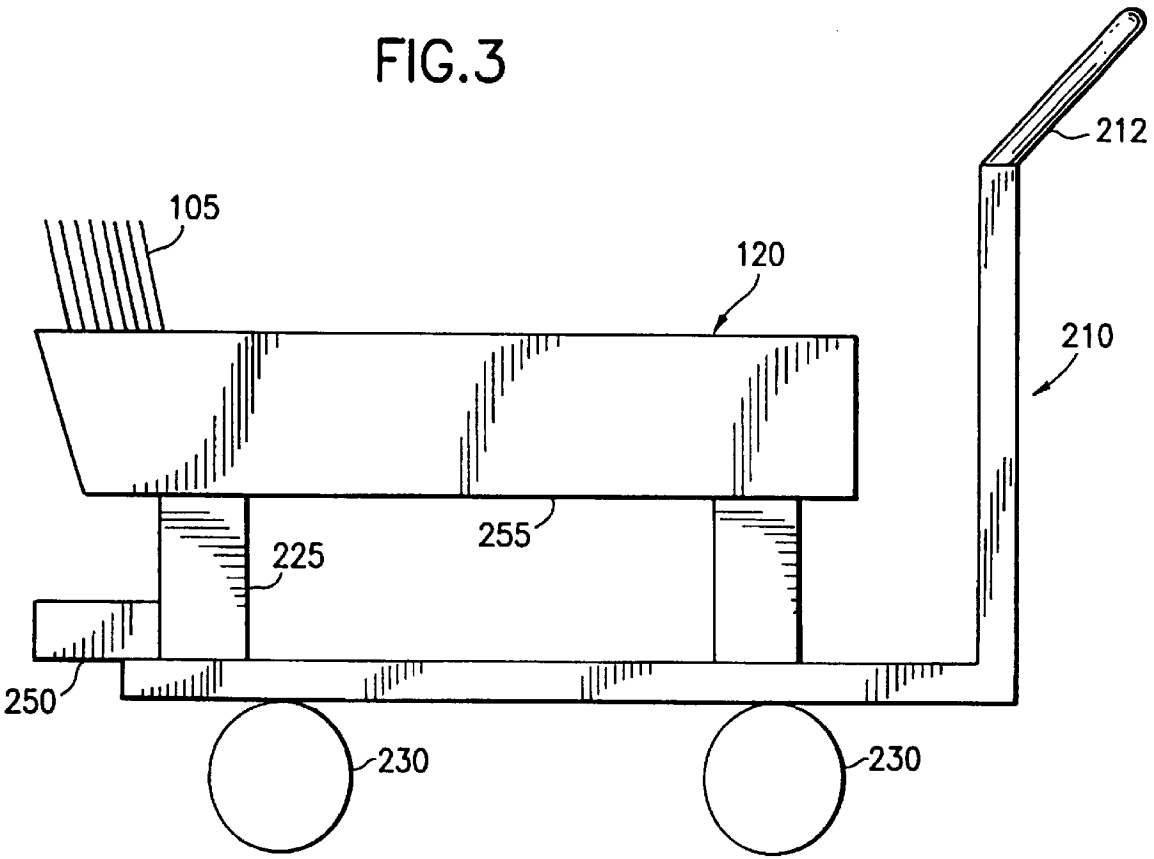
FIG. 3 is a side view of the sheet handling cart before docking.

A best embodiment of the sheet handling cart 210 according to the present invention is shown in FIG. 3. The cart comprises the paper trough 120 for carrying the stack of paper 105, moving means 230, and the docking mechanism 250 for docking the cart. The side of the trough facing the front of the cart is preferably tilted, and therefore the stack of paper will lean toward the front of the cart as shown in FIG. 3. The handle 212 facilitates steering and pushing.

Figure 4:
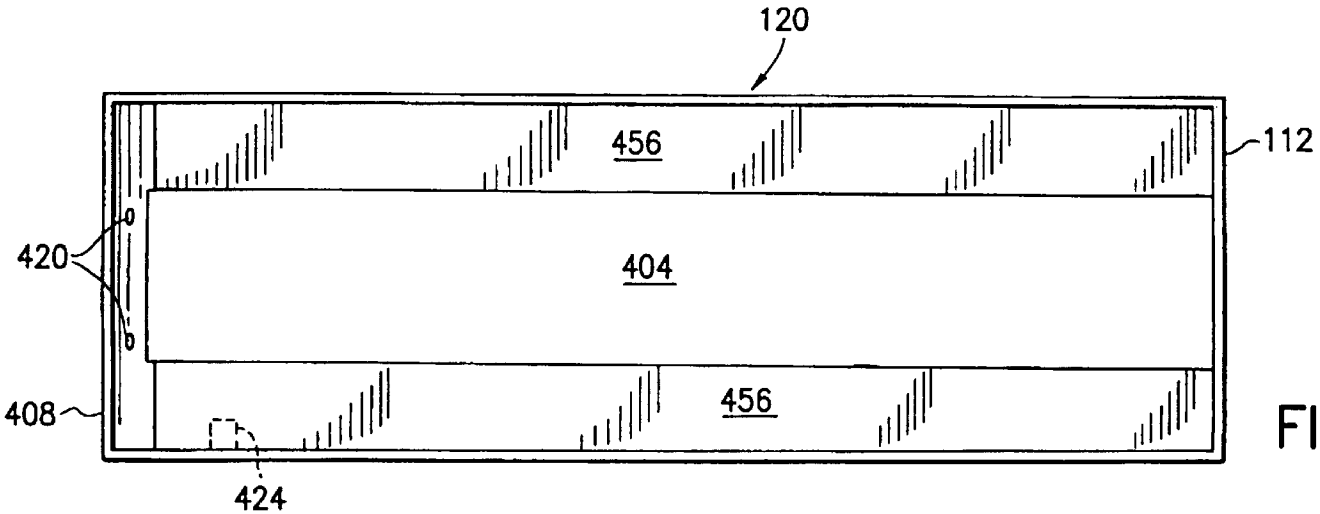
FIG. 4 is a top view of the empty paper trough.

The paper trough may include openings 420 through which a detector can look into the trough, as seen in FIG. 4 which is a top view of the paper trough. The paper trough 120 has a trough bottom 456 which longitudinally forms an elongated opening 404 narrower than the bottom of the paper trough. The width of the paper trough should be slightly greater than the width of the paper used, and therefore different troughs would be used for paper having different widths. As already discussed, the opening 404 is dimensioned to accommodate the conveyor belt that will protrude upward through the elongated opening 404, after the paper trough 120 is lifted from the frame; the conveyor belt will then be in position to advance the stack of paper toward the sheet feeder.

The elongated opening 404 extends throughout the length of the paper trough 120 from a front end 408 of the paper trough to a back end 112 of the paper trough. The elongated opening 404 is rectangular in shape.

Figure 5:
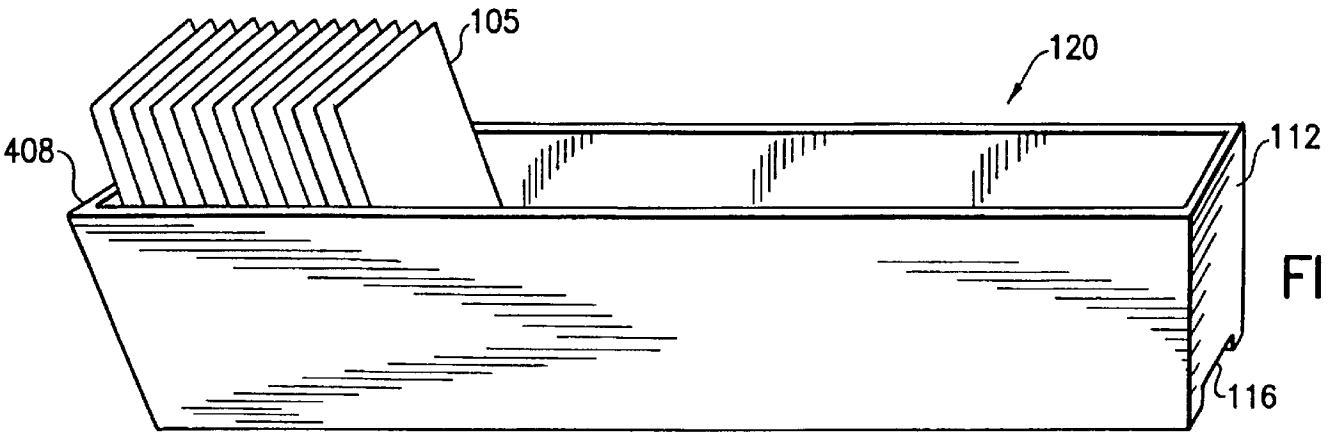
FIG. 5 is a side view of the paper trough.

The front end 408 of the trough forms, along its bottom edge, a rectangular indentation 416 aligned with the rectangular elongated opening 404, so that the conveyor belt will fit into the rectangular indentation 416 and come into firm contact with the paper stack. The indentation 416 may also be sufficiently large so that the openings 420 are unnecessary; i.e. a detector could look into the trough through the indentation 416. FIG. 5 shows that the back end 112 of the trough also forms, along its bottom edge, the rectangular indentation 116 aligned with the rectangular elongated opening 404, so that the conveyor belt will fit into the rectangular indentation 416 and come into firm contact with the paper stack.

The present system is configured so that, in this embodiment, the front end 408 will be closer to the docking station than the back end 112 when the sheet handling cart 120 connects to the docking station. As already mentioned, FIG. 4 shows that the front end 408 forms at least two openings 420 dimensioned so that respectively at least two of the reflective detectors 160 (shown in FIG. 1) will use the at least two openings 420 to detect a position of the stack of paper from outside the trough. Alternatively, the paper trough 120 has at least one mechanical switch 424 for detecting a position of the stack of paper. The mechanical switch 424 would be operatively connectable to the conveyor 140 so that the conveyor belt 145 starts and stops depending upon the position of the stack of paper 105 in relation to the front end 408.

In the embodiment shown in FIG. 5, which shows a side view of the paper trough 120, each sheet of paper within the stack of paper would be within 15 degrees of vertical when the sheet handling cart connects to the docking station. In a preferred embodiment, the paper trough 120 would be within 10 degrees of horizontal, with the paper trough configured so that any sheet of paper in the stack of paper 105 is within ten degrees of being perpendicular relative to the paper trough, and thus the stack of paper would exert a small component of its weight on the high-speed sheet feeder.

Figure 6:
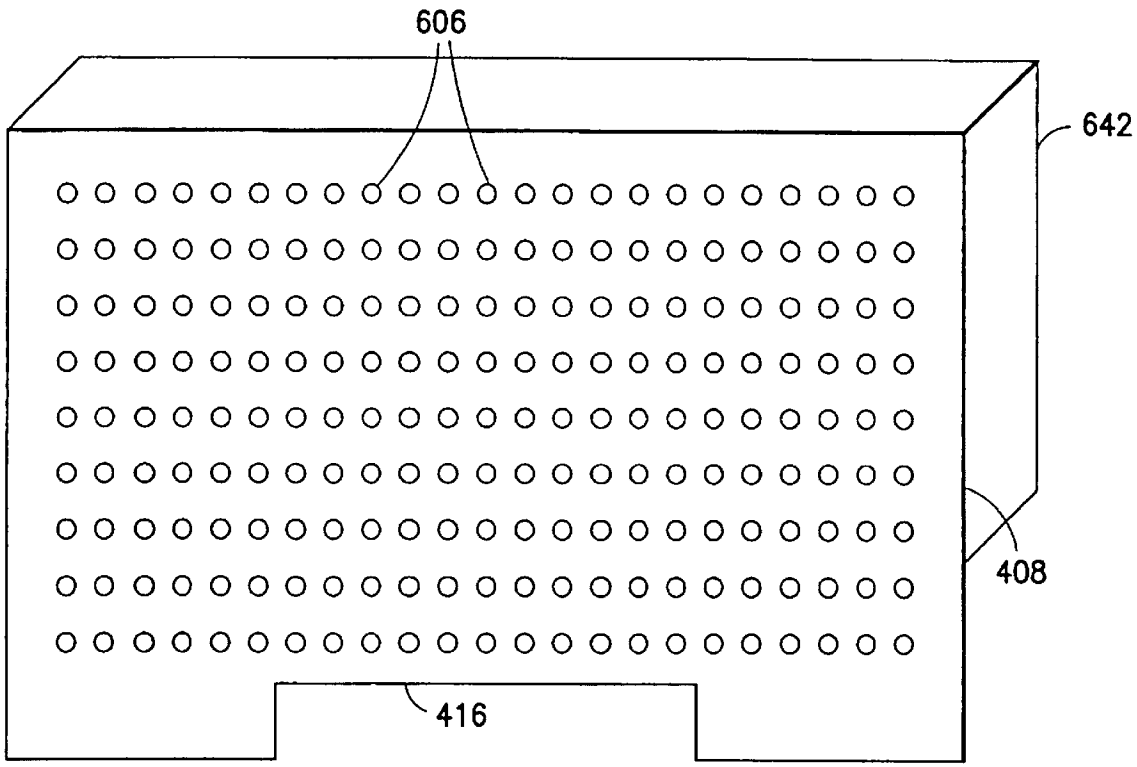
FIG. 6 shows a slidably removable front end of the paper trough with optional air supply.

The front end 408 of the paper trough may be slidably removable from the paper trough, as shown in FIG. 6, wherein it is assumed that the rectangular indentation 416 is large enough to accommodate the conveyor belt and also allow detectors to peer into the trough. The front end 408 may advantageously also include a plurality of air holes 606 for allowing air to blow into the paper trough and thus form an air cushion between the front end 408 and the stack of paper. This air flow may emanate from the fixed vertical feed deck 108 (see FIG. 1), or it may emanate from an optional air deck 642 attached to the front end 408, wherein the air deck 642 is connectable to an air hook-up when the cart is docked.

Figure 7:
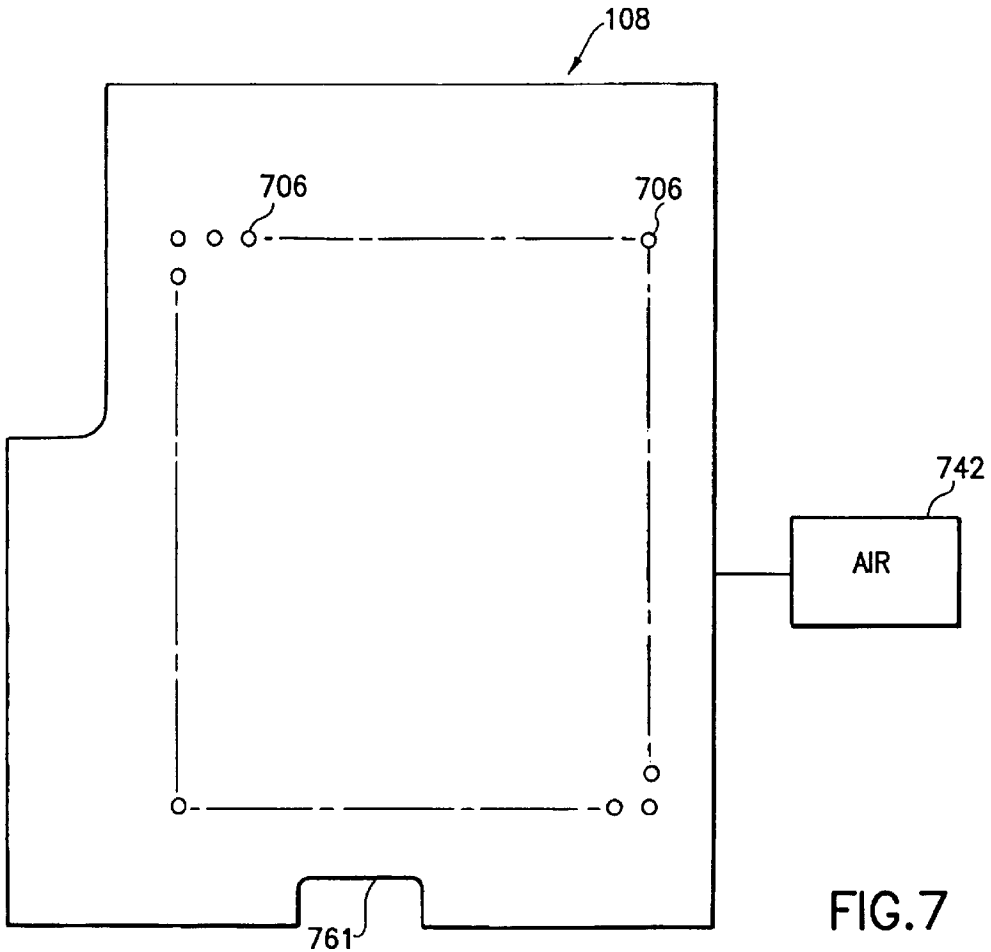
FIG. 7 depicts a vertical feed deck.
Figure 8:
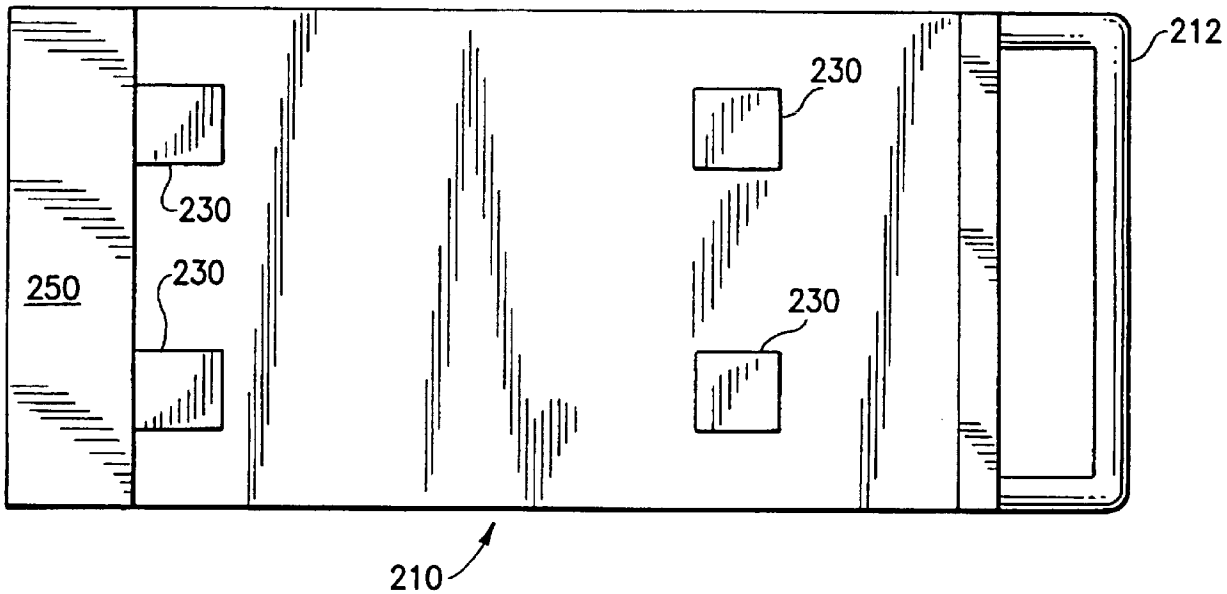
FIG. 8 is a top view of the sheet handling cart.

FIG. 7 is an enlarged view of the vertical feed deck 108 that is attached to the high-speed sheet feeder depicted in FIG. 1. In this embodiment, the feed deck has a plurality of air holes 706, and also has an opening 761 where the sensors 160 may be located, as depicted in FIG. 1. The air supply device 742 pumps air through the holes 706. FIG. 8 is simply a top view of the cart 210 already shown and described with reference to FIG. 3.

Referring again to the embodiment in FIG. 1, the at least one detector 160 is operatively connected to the elevating conveyor 140 so that the elevating conveyor belt 145 will operate in response to the position of the stack of paper 105. The detector 160 will preferably be a reflective detector, although another type of detector, such as a mechanical detector, could be used. The detector 160 will be operatively connected to the conveyor belt via a controller 121 which will activate a conveyor belt motor 117 in response to input received from the detector 160. The controller will also be responsible for activating an elevating motor 119 in order to operate the elevating mechanism 143, in response to a paper height sensor 126 that senses whether the tops of the sheets of paper are properly positioned to be fed by the feed drum 109 into the rest of the high-speed sheet feeder 107. The reflective detector 160 is for emitting radiation through a hole formed by a side of the paper trough, and for sensing the reflected radiation in order to obtain necessary information regarding the position of the stack of paper 105.

Figure 9A:
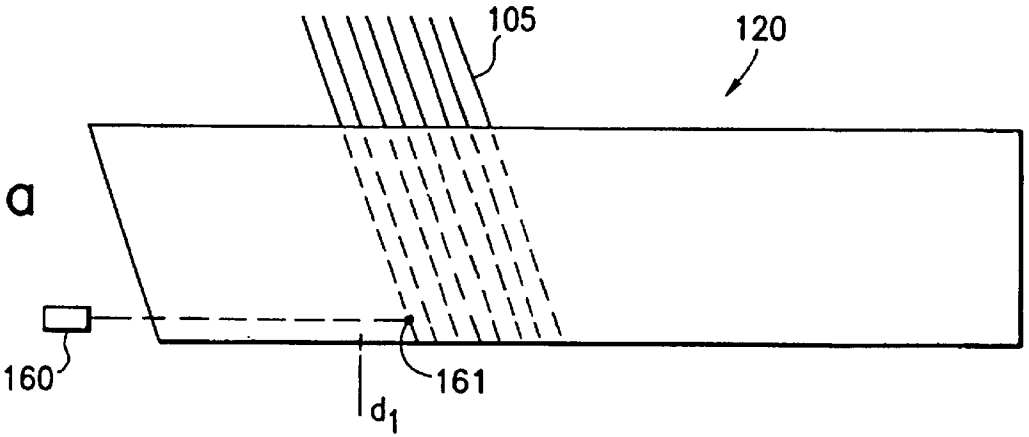
FIGS. 9*a* and 9*b* are side views of the paper trough illustrating the bottom of the paper stack at different distances from a sensor.
Figure 9B:
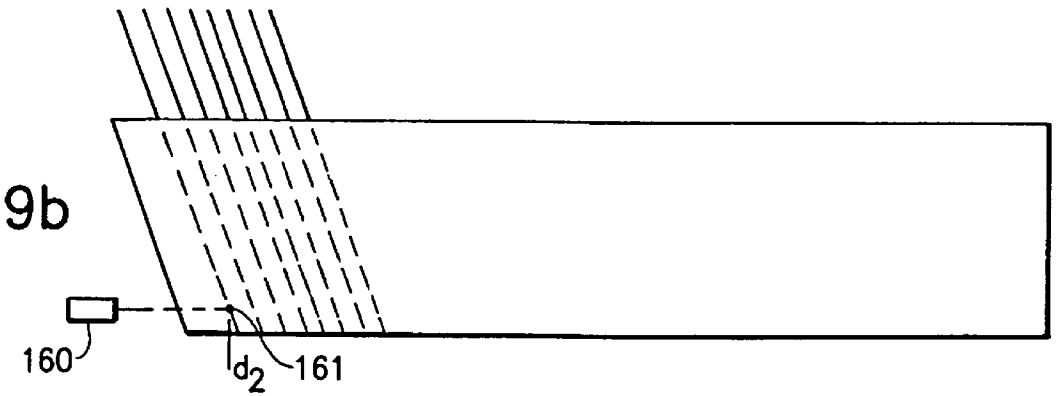

In a preferred embodiment, the conveyor belt 145 will advance paper toward the high-speed sheet feeder in response to the bottom of the stack of paper 105 being more than a first fixed distance $d_1$ from the sensor 160. This position is illustrated in FIG. 9*a*. The conveyor belt 145 will stop advancing paper in response to the stack of paper being less than a second fixed distance $d_2$ from the sensor, the first fixed distance being greater than the second fixed distance. This is illustrated in FIG. 9*b*. In other words, whenever the bottom of the stack of paper is far enough from the sheet feeder 107, the conveyor belt 145 will bring the stack closer until the stack is close enough. The first fixed distance $d_1$ may advantageously be between 0.50 inches and 1 inch, and the second fixed distance $d_2$ may advantageously be less than 0.25 inches. As already discussed, the detector 160 shown in FIGS. 9*a* and 9*b* may advantageously be a visual detector which measures the distance from the detector to the point 161 where the detector's line of sight hits the stack of paper 105. However, someone skilled in the art will understand that, if another type of detector is used, such as a mechanical detector, then still the operation of the conveyor belt 145 can be similarly controlled based upon the position of the stack of paper 105.

The elevating conveyor 140 is preferably configured to elevate the paper trough 120 an adjustable distance that is adjustable depending upon how large each sheet of paper is. For example, if each sheet of paper in FIG. 1 were larger, then it would be desirable to lower the paper trough 120 in order to properly align the top of each sheet of paper.

Certain changes may be made in the above best mode without departing from the scope of the invention, as will be understood by those skilled in the art. It is intended that all matter contained in the above description or shown in the accompanying drawings shall be interpreted as illustrative and not in a limiting sense. The invention disclosed herein can be implemented by a variety of combinations of hardware and software, and those skilled in the art will understand that those implementations are derivable from the invention as disclosed herein.

What is claimed is:

1. A system for delivering a stack of paper to a high-speed sheet feeder, comprising:

(a) a sheet handling cart including a frame and a paper trough that is liftable from the frame, the paper trough having a trough bottom that forms an elongated opening;

(b) a docking station connected at least indirectly to the high-speed sheet feeder, said docking station having a station docking mechanism for removably attaching the sheet handling cart to the docking station;

(c) an elevating conveyor belt connected at least indirectly to the docking station, for protruding upward through the elongated opening of the trough bottom, in order to advance the stack of paper toward the high-speed sheet feeder; and (d) at least one detector for obtaining information regarding a position of the stack of paper, wherein the at least one detector is operatively connected to the elevating conveyor belt so that the elevating conveyor belt will operate in response to the position of the stack of paper.

2. The system of claim 1, wherein at least one side of the paper trough forms a plurality of air holes allowing an air flow to enter the trough and thereby create a buffer between the at least one side and the stack of paper.

3. The system of claim 1, wherein the trough bottom includes at least one trough contact surface which is at least partly exposed when the sheet handling cart connects to the docking station, and wherein the system is arranged in a configuration so that the elevating conveyor belt will contact the at least one trough contact surface and thereby lift the paper trough off the sheet handling cart after the sheet handling cart connects to the docking station.

4. The system of claim 1, wherein the elevating conveyor belt is configured to elevate the paper trough an adjustable distance which is adjustable depending upon how large each sheet of paper is.

5. The system of claim 1, wherein the paper trough comprises an air deck connectable to an air hook-up of the docking station for creating an air buffer between the air deck and the stack of paper.

6. The system of claim 1, wherein the at least one detector includes at least one reflective detector connected at least indirectly to the docking station, wherein the at least one reflective detector is for emitting radiation through a hole formed by a side of the paper trough, and wherein the at least one reflective detector is also for sensing reflected radiation in order to obtain the information regarding the position of the stack of paper.

7. The system of claim 1, wherein the at least one detector includes at least one mechanical switch.

8. The system of claim 1, wherein the at least one detector is configured so that the elevating conveyor belt will advance paper in response to the stack of paper being more than a first fixed distance from a side of the paper trough, and will stop advancing paper in response to the stack of paper being less than a second fixed distance from the side of the paper trough, the first fixed distance being greater than the second fixed distance.

9. The system of claim 1, wherein the sheet handling cart further includes a tilting mechanism for tilting the paper trough between at least a first stacking configuration and a second feeder configuration, wherein the paper trough is within 10 degrees of vertical in the first stacking configuration, and wherein the paper trough is substantially horizontal in the second feeder configuration.

* * * * *